US009761387B2

(12) United States Patent
Fasano

(10) Patent No.: US 9,761,387 B2
(45) Date of Patent: Sep. 12, 2017

(54) DOUBLE POLE BREAKER WITH TANDEM ARRANGEMENT

(71) Applicant: Michael Fasano, Watertown, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 74 days.

(21) Appl. No.: 14/812,509

(22) Filed: Jul. 29, 2015

(65) Prior Publication Data

US 2017/0032905 A1 Feb. 2, 2017

(51) Int. Cl.

| | |
|---|---|
| ***H01H 27/10*** | (2006.01) |
| ***H01H 9/26*** | (2006.01) |
| ***H01H 71/10*** | (2006.01) |

(52) U.S. Cl.

CPC ..... *H01H 9/26* (2013.01); *H01H 71/1018* (2013.01); *H01H 71/1027* (2013.01)

(58) Field of Classification Search

CPC ..... H01H 71/00; H01H 71/02; H01H 71/025; H01H 71/0264; H01H 71/0271; H01H 71/1009; H01H 71/10; H01H 71/1027; H01H 71/46; H01H 71/465; H01H 71/52; H01H 71/12; H01H 71/24; H01H 71/08; H01H 71/1018; H01H 73/36; H01H 73/40; H01H 73/44; H01H 9/26; H01H 27/10

USPC ..... 200/42.01, 333, 43.01, 43.11, 200/43.14–43.16, 43.19, 43.22, 43.07, 200/239, 321, 327, 339, 16 R, 16 C, 400, 200/50.32

See application file for complete search history.

(56) References Cited

U.S. PATENT DOCUMENTS

| | | | | |
|---|---|---|---|---|
| 2,531,157 A | | 11/1950 | Pifke | |
| 3,171,931 A | | 3/1965 | Powell | |
| 3,171,932 A | * | 3/1965 | Beaudoin | H01H 71/1027 200/50.4 |
| 4,504,807 A | | 3/1985 | Nar | |
| 6,700,082 B1 | | 3/2004 | Gibson et al. | |
| 2008/0191820 A1 | * | 8/2008 | McCoy | H01H 9/26 335/127 |

FOREIGN PATENT DOCUMENTS

| | | |
|---|---|---|
| DE | 19534612 A1 | 5/1996 |
| EP | 0737994 A1 | 10/1996 |

* cited by examiner

*Primary Examiner* — Anthony R Jimenez

(74) *Attorney, Agent, or Firm* — St. Onge Steward Johnston & Reens, LLC

(57) ABSTRACT

A circuit breaker assembly includes a plurality of circuit breakers each including a housing with a trip mechanism therein and each having an opening in a side of the respective housing. Each trip mechanism has a coupler disc connected thereto. The plurality of circuit breakers are aligned in an end-to-end fashion with a trip member positioned along a side of the housings and connected to the coupler discs such that if the first trip mechanism actuates from a untripped state to a tripped state the trip member actuates the second trip mechanism from a untripped state to a tripped state and vice versa.

20 Claims, 8 Drawing Sheets

DOUBLE POLE BREAKER WITH TANDEM ARRANGEMENT

FIELD OF THE INVENTION

The invention relates to a multi-pole circuit breaker arrangement in general, and in particular to a multi-pole circuit breaker arrangement that provides two or more circuit breakers arranged in tandem wherein the circuit breakers tripping mechanisms are connected via a trip member such that the tripping of one circuit breaker will cause the interconnected breakers to trip simultaneously.

BACKGROUND OF THE INVENTION

This invention relates to circuit breakers used to protect an electrical circuit from damage caused by ground fault or a short circuit. If a power surge occurs in a circuit protected by the circuit breaker, for example, the breaker will trip. This will cause a breaker that was in the "on" position to flip to the "off" position, and will interrupt the electrical power leading from that breaker. By tripping in this way, a circuit breaker can prevent damage from occurring on an overloaded circuit, and can also prevent the destruction of the device that is drawing the electricity or other devices connected to the protected circuit.

A typical circuit breaker includes a line and a load. Generally, the line is connected to an incoming electrical power source, e.g., power supplied from a power network such as a utility line. This is sometimes referred to as the input into the circuit breaker. The load, sometimes referred to as the output, connects the circuit breaker to the electrical circuit and components connected to the circuit being fed from the circuit breaker. A circuit breaker may protect an individual component connected directly to the circuit breaker, for example, an air conditioner, or a circuit breaker may protect multiple components, for example, household appliances connected to a circuit which terminates at electrical outlets.

It is known to provide to provide circuit breakers of a fixed type in the panel board. For example, single pole, two-pole and three-pole circuit breakers are all known, which can variously be connected to single phase, two-phase and three-phase circuit for feeding particular circuits. However, a three-phase circuit breaker can only ever be configured as a three-phase circuit breaker and cannot be used to feed a single phase load.

In some applications, it is desirable to have two or more circuit breakers interconnected such that they trip simultaneously. For example, U.S. Pat. No. 4,504,807, which is hereby incorporated by reference, discloses a multi-pole circuit breaker arrangement where a common trip coupler connects the circuit breakers through abutting side walls of the switch cases. In this arrangement, opposing portions cooperate with portions of a U-shaped common trip members inside the adjacent switch cases in order to cause pivotal movement of one of these members to achieve coaxial movement of the coupler and hence of the adjacent trip member in the adjacent case. The multi-pole circuit breaker also has a single handle attached to an elongated internal connector for actuating the breakers in unison with one another.

However, the circuit breaker arrangement disclosed in U.S. Pat. No. 4,504,807 has many disadvantages. For instance, the arrangement of the breakers is bulky and requires a large space to fit in a circuit breaker panel. This is a problem in situations where space is limited and a multi-pole breaker with a slim foot print is needed. Such scenarios regularly happen in modern space efficient circuit breaker panels and in other areas, such as server rooms where it is necessary to have a multi-pole circuit breaker in a slim area between servers.

Another problem with prior art designs, is that in order to assemble the three pole design disclosed, at least three different types of circuit breakers must be manufactured. This is necessitated by the need to interconnect the breakers through a cavity in the abutting side walls of the switch cases. Thus, for the design shown, the middle breaker must have a cavity on both abutting sidewalls, while two side breakers require a cavity on opposing side walls. Still another problem with the prior art design is that not only must differing switch cases be made for the side wall cavities, but also for the single handle arrangement. Thus, while the center breaker has a top opening for the single handle, the switch cases for the side breakers have a flat top. As a result, at least six different cases must be manufactured in order to assemble the breaker disclosed.

SUMMARY OF THE INVENTION

It is desired, therefore, to provide a slim-profile multi-pole circuit breaker arrangement where a common trip coupler may be used to connect a at least two separate circuit breakers.

It is further desired to provide a multi-pole circuit breaker design that requires less unique parts, which is relatively inexpensive to manufacture and inventory.

Accordingly, one object is to provide a circuit breaker assembly including a first circuit breaker having a first housing containing a first trip mechanism with a first axis of operation, the first housing having a first circular opening; a second circuit breaker having a second housing containing a second trip mechanism with a second axis of operation, the second housing having a second circular opening; a first coupler disc in the first opening and connected to the first trip mechanism; a second coupler disc in the second opening and connected to the second trip mechanism; the first circuit breaker and the second circuit breaker aligned such that the first axis of operation and the second axis of operation are substantially parallel and separated by a first distance; an elongated trip member having a first end with a first pivot connection and a second end with a second pivot connection; the first pivot connection connected to the first coupler disc and the second pivot connection connected to the second coupler disc such that when the first trip mechanism actuates from a untripped state to a tripped state, the elongated trip member actuates the second trip mechanism from a untripped state to a tripped state; and a cover extending over the trip member, the cover fastened to the housing of first circuit breaker and the housing of the second circuit breaker.

It is another to provide a circuit breaker assembly wherein each of the circuit breakers has a handle for manually actuating the trip mechanisms between the untripped state and the tripped state and where the handles are coupled via a connector. In one example, the connector may be a bar that is attached to the handles via a fastener.

In other examples the connector is a one-piece assembly having a center section from which a first and a second set of legs protrude from opposite sides, the first set of legs having a set of first projections protruding inward and the second set of legs having a set of second projections protruding inward, where the first set of projections connect to one handle and the second set of projections connect to the other handle.

In still other examples, the connector is an elongated slider having a first end with a first cavity and a second end with a second cavity, where one handle fits into the first cavity and the other handle fits into the second cavity.

It is yet a further object to provide a circuit breaker assembly where a first gap between the first opening and the first coupler disc and a second gap between the second opening and the second coupler disc are provided such that an inner edge of the first opening acts as a bearing surface for an outside edge of the first coupler, and an inner edge of the second opening acts as a bearing surface for an outside edge of the second coupler.

These and other objects are achieved by providing a circuit breaker assembly including a first circuit breaker having a first housing containing a first trip mechanism, the first housing having a side, a first end of the first housing and a second end of the first housing, the first and second ends of the first housing being perpendicular to the side of the first housing and being parallel to one another; a second circuit breaker having a second housing containing a second trip mechanism, the second housing having a side, a first end of the second housing and a second end of the second housing both being perpendicular to the side of the second housing and being parallel to one another; the first circuit breaker and the second circuit breaker aligned such that the second end of the first housing and the first end of the second housing contact one another; and an elongated trip member that runs along the side of the first housing and the side of the second housing, the elongated trip member connected to the first trip mechanism through an opening in the side of the first housing and the second trip mechanism through an opening in the side of the second housing, such that when the first trip mechanism actuates from a untripped state to a tripped state, the elongated trip member actuates the second trip mechanism from a untripped state to a tripped state.

It is another object to provide a circuit breaker assembly wherein a first circuit breaker has a first handle for manually actuating the first trip mechanism between the untripped state and the tripped state, and a second circuit breaker has a second handle for manually actuating the second trip mechanism between the untripped state and the tripped state, such that the first handle and the second handle are mechanically coupled together via a connector. In one example, the connector is a bar that is attached to the first handle by a first fastener and the second handle by a second fastener.

In other embodiments the connector is a one-piece assembly having a center section from which a first and second set of legs protrude from opposite sides, the first set of legs having a set of first projections protruding inward and the second set of legs having a set of second projections protruding inward, wherein the first set of projections connect to a first handle and the second set of projections connect to a second handle.

In still other examples, the connecter is an elongated slider having a first end with a first cavity and a second end with a second cavity, where the first handle fits into the first cavity and the second handle fits into the second cavity.

It is yet a further object to provide a circuit breaker assembly including a first and second coupler, where the first coupler fits into a first opening and is connected to a first trip mechanism and a second coupler fits into a second opening and is connected to a second trip mechanism such that the elongated trip member is connected to the first and second coupler.

It is another object to provide a circuit breaker assembly such that a first opening and a second opening in the respective housings are circular, and first and second couplers are provided as discs. In certain examples a first gap between a first opening and a first coupler disc and a second gap between a second opening and a second coupler disc are provided such that an inner edge of the first opening acts as a bearing surface for an outside edge of the first coupler, and an inner edge of the second opening acts as a bearing surface for an outside edge of the second coupler.

Other objects are achieved by providing a circuit breaker assembly including a plurality of circuit breakers, each circuit breaker comprising a housing having a side and first and second ends that are perpendicular to the side, the two ends being parallel to one another. The circuit breaker assembly further includes a handle that is moveable between an on position and an off position, and a circuit breaker linkage mechanism having a tripped state and an untripped state. The circuit breaker linkage mechanism is disposed to change a position of at least one contact when the circuit breaker linkage mechanism changes state, and the circuit breaker linkage mechanism is operably connected between the handle and the at least one contact, such that movement of the handle causes movement of the circuit breaker linkage mechanism, thereby causing movement of the at least one contact. The circuit breaker linkage mechanism further includes an opening on a first side of the breaker, where the plurality of breakers are aligned end to end such that the sides of the housings are oriented in the same direction and are aligned on a plane. The circuit breaker linkage mechanism is provided such that an elongated trip member extends along the sides of the plurality of circuit breakers, the elongated trip member being mechanically connected to each of the circuit breaker linkage of the plurality of breakers such that when one of the circuit breaker linkages actuates from the untripped state to the tripped state, the remaining circuit breaker linkages of the plurality of circuit breakers are also actuated from the untripped state to the tripped state. Finally, the circuit breaker linkage mechanism includes a handle coupler connecting each handle of the plurality of breakers allowing a user to simultaneously actuate the plurality of circuit breakers.

Other objects of the invention and its particular features and advantages will become more apparent from consideration of the following drawings and accompanying detailed description.

DETAILED DESCRIPTION OF THE INVENTION

Figure 1:
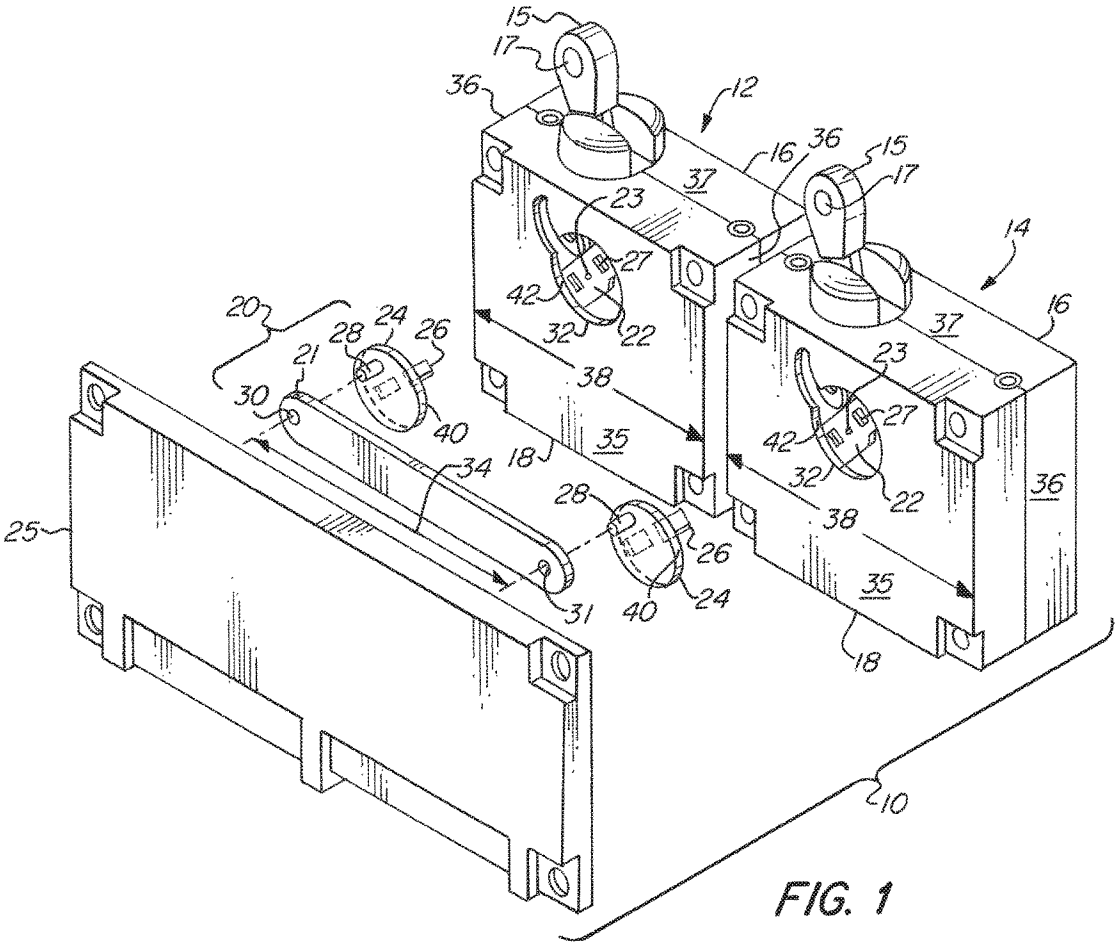
FIG. 1 is an illustration of two circuit breakers showing an exploded view of the trip member connection.
Figure 2:
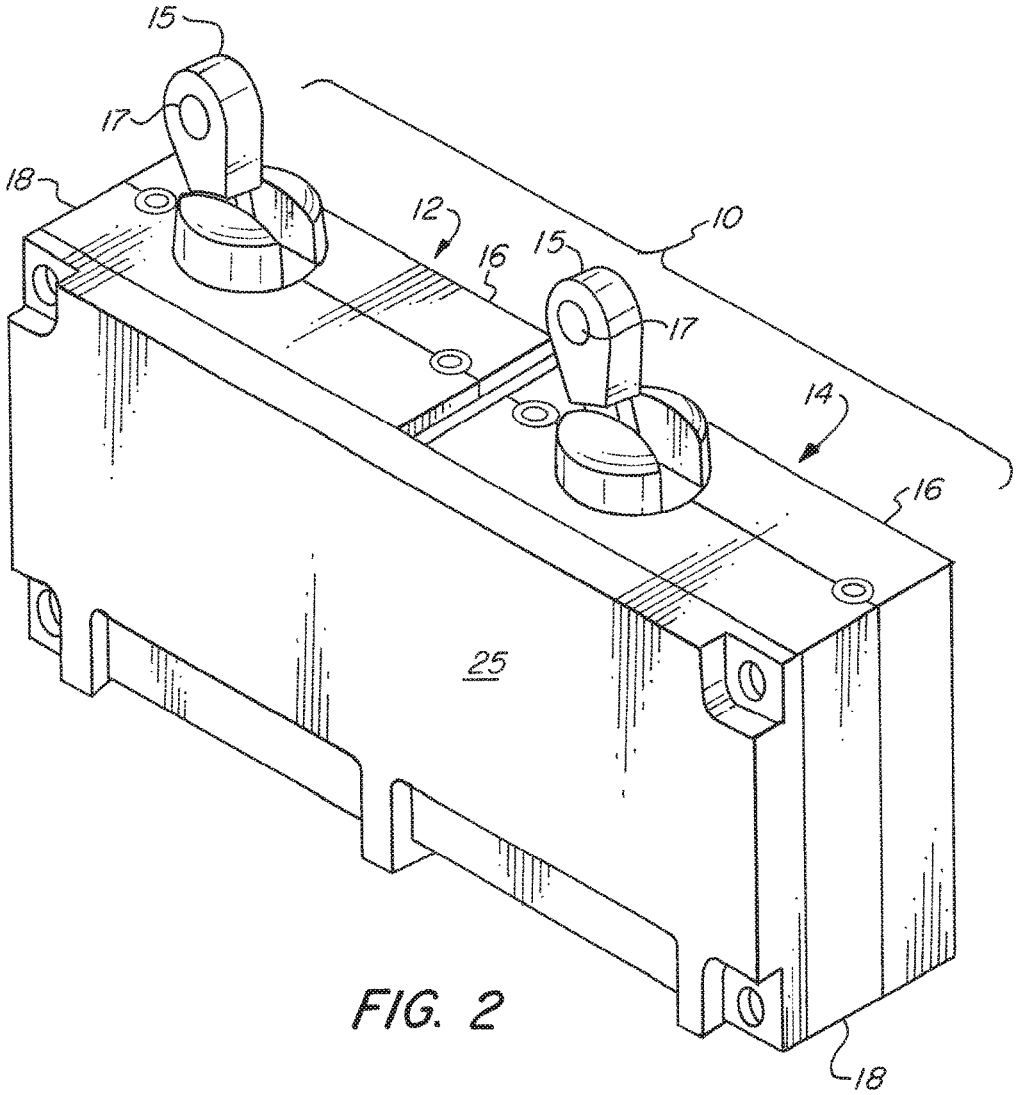
FIG. 2 is an illustration of the two circuit breakers according to FIG. 1.

FIGS. 1-2 show a multi-pole circuit breaker 10 according to aspects of the invention. FIG. 1 illustrates an exploded view of the multi-pole circuit breaker 10. The multi-pole circuit breaker includes two circuit breakers 12, 14, each having a manual switch handle 15 and an actuator 22 for the trip mechanisms connected via a common trip assembly 20. The common trip assembly 20 is concealed by a cover 25 which also connects the two circuit breakers 12, 14 together. As can be seen in FIG. 1 both circuit breakers 12, 14 have the same housing assembly made up of an outside case 16 and an inside case 18. The inside case 18 has a circular opening 32 which provides access to the actuator 22 for the tripping mechanism. Each of the circuit breakers 12, 14 has a top 37 from which the manual switch handle 15 extends, two ends 36 that have the same width as the top 37 and a front face 35. The circuit breakers 12, 14 are aligned end 36 to end 36 and the front face 35 of each of the circuit breakers 12, 14 form a larger surface. The actuators 22 are separated such that the actuator pivot points 23 are separated by a distance that in the preferred embodiment is greater than or equal to the length 38 of the front face 35.

The common trip assembly 20 comprises a coupler disc 24 for each of the two circuit breakers 12, 14 and an elongated trip member 21 which connects the coupler discs 24. For each coupler disc 24, one side has two projections 26 which fit into corresponding openings 27 in the actuator 22 and on the other side has a single pivot projection 28. The elongated trip member 21 has two spaced apart pivot openings 30, 31, which fit onto a corresponding pivot projection 28 to form two spaced apart pivot points on the elongated trip member 21. The space separating the pivot openings 30, 31 is approximately equal to the space separating the actuator pivot points 23. When assembled, the coupler disc 24 fits into the circular opening 32 of the inside case 18 such that the elongated trip member sits along the exterior front face 35 of the inside case 18 of the circuit breakers 12, 14.

Figure 4:
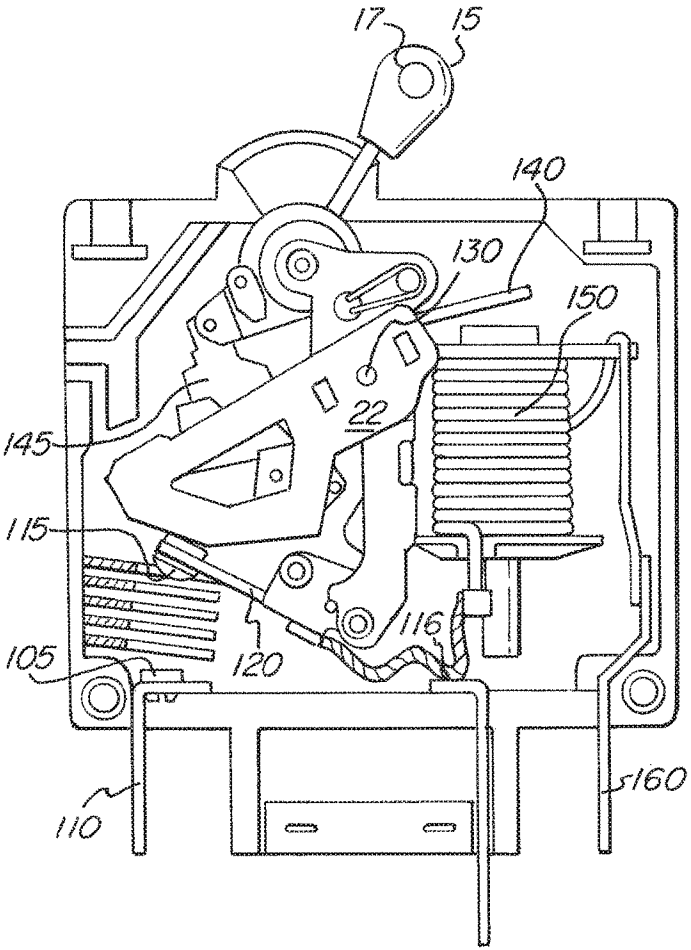
FIGS. 3 and 4 are illustrations of one of the circuit breakers according to FIG. 1 in the closed and open positions respectively.
Figure 3:
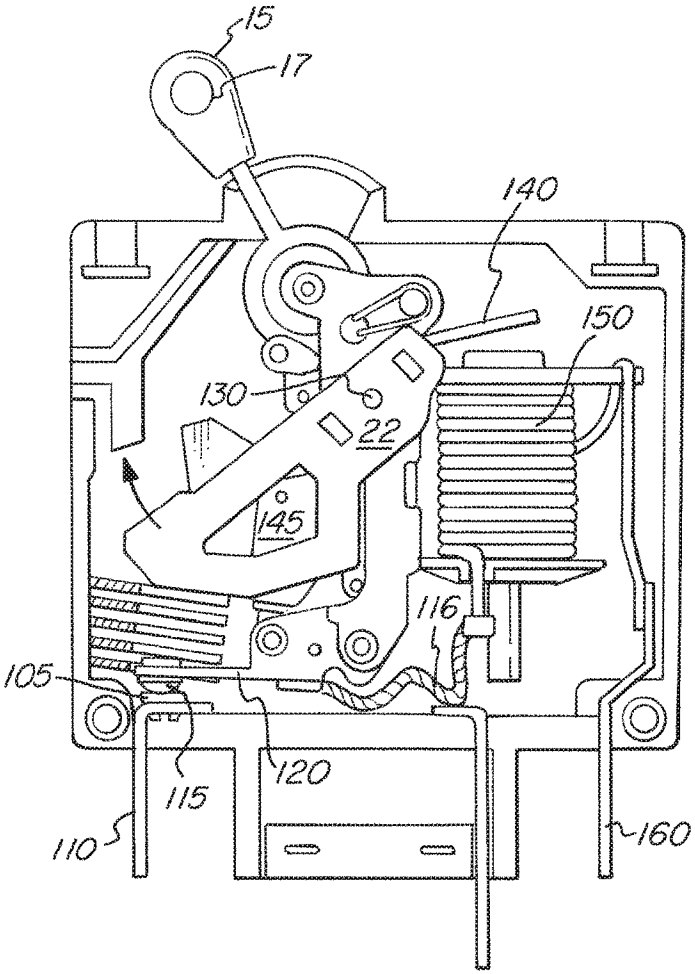

FIGS. 3-4 are a side view of the internal components of each circuit breaker 12, 14. The circuit breaker includes a stationary contact 105 connected to a line terminal 110. The line terminal receives electricity from a power source. A movable contact 115 is disposed on a movable contact arm 120 which can be moved between a closed position shown in FIG. 3 and an open position/tripped state shown in FIG. 4.

The movable contact 115 is connected to a load terminal 160 through a fault detector 150 and a connector 116. When the movable contact 115 is in a closed position/untripped state, as shown in FIG. 3, the stationary contact 105 and the moveable contact 115 are in contact with each other, and electricity can flow from line terminal 110 to load terminal 160 through contacts 105 and 115.

The movable contact arm 120 is also connected to a tripping mechanism 140 which includes a collapsible linkage 145. The fault detector 150 is configured to activate the tripping mechanism 140 when a fault condition occurs, such as excess current, thereby causing the collapsible linkage 145 to collapse and separating the contacts 105, 115. The collapsible linkage 145 can also be collapsed via the actuator 22 when the actuator 22 is rotated in a clockwise direction.

In some applications, the fault detector is a solenoid which is disposed inline with the circuit. If the current through the solenoid exceeds a certain level, the solenoid generates an electromagnetic field sufficient to activate the tripping mechanism. The solenoid may also optionally incorporate a plunger or other armature which activates the tripping mechanism when the current exceeds a certain level.

It is understood that other fault detection methods may also be employed, which trip the tripping mechanism upon the occurrence of a specific condition.

The handle 15 is connected to the movable contact arm 120 via the collapsible linkage 145. The handle 15 is provided for opening and closing movable contact arm 120.

Figure 5:
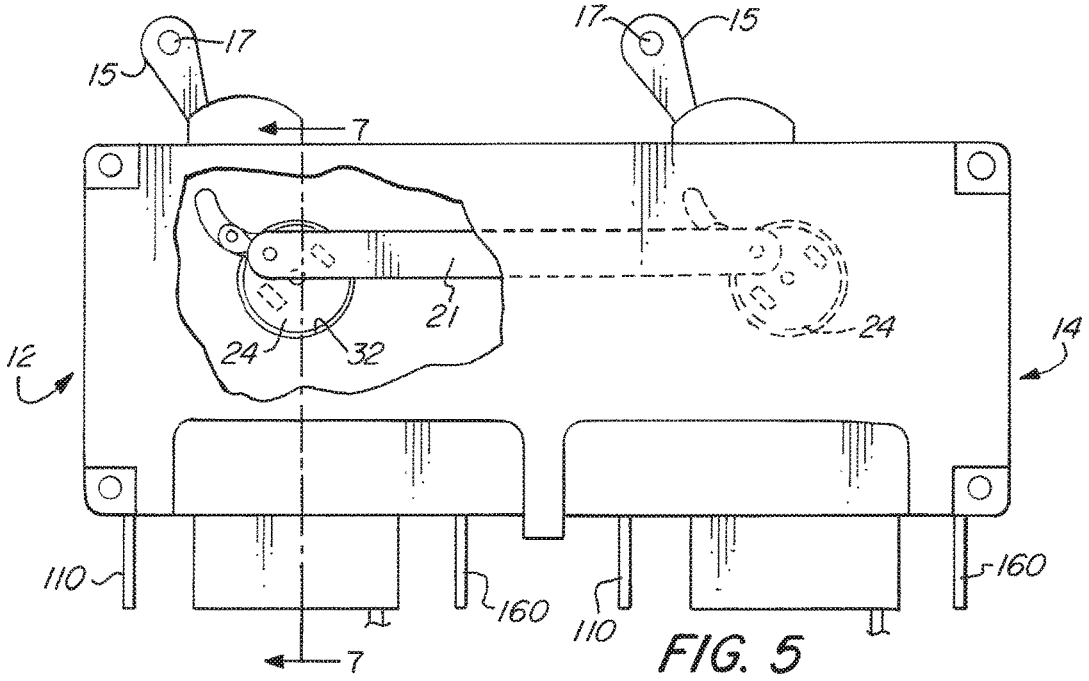
FIG. 5 is an illustration of the circuit breakers according to FIG. 1 showing the trip member connection in the closed position.
Figure 6:
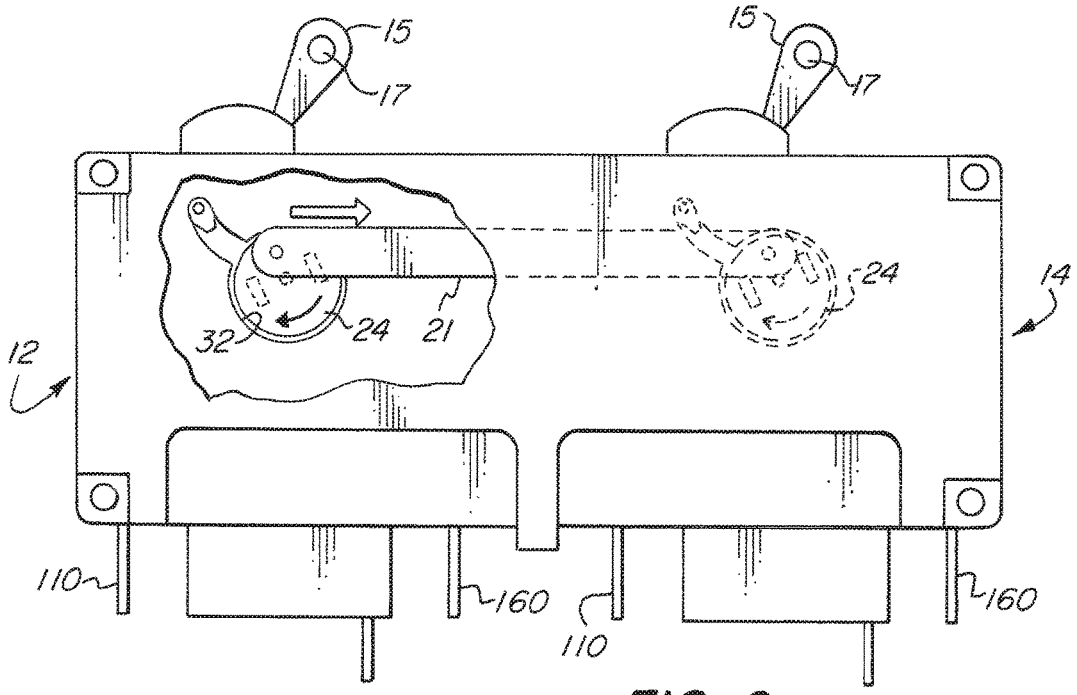
FIG. 6 is an illustration of the circuit breakers according to FIG. 1 showing the trip member connection in the open position.

FIGS. 5-6 are a side cut-away view of the assembled breakers 12, 14 and the common trip assembly 20 of FIG. 1. FIG. 5 shows the assembled breakers 12, 14 in the untripped state and FIG. 6 shows the assembled breaker 12, 14 in the tripped state. As signified by the arrow in FIG. 5, when one of the breakers 12, 14 trips, the elongated trip member 21 trips the other breaker by either pushing or pulling the interconnected coupler disc 24 of the untripped breaker. Thus, if the left circuit breaker 12 experiences a fault condition, such as excess current, the fault detector 150 will activate the tripping mechanism 140 causing the collapsible linkage 145 to collapse, separating the contacts 105, 115 and rotating the coupler disc 24 clockwise. The rotation of the coupler disc 24 in the left circuit breaker 12 is then transmitted to the coupler disc 24 of the right circuit breaker 14 through the elongated trip member 21 activating the tripping mechanism 140 causing the collapsible linkage 145 to collapse and separating the contacts 105, 115 of the right circuit breaker 14.

Figure 7:
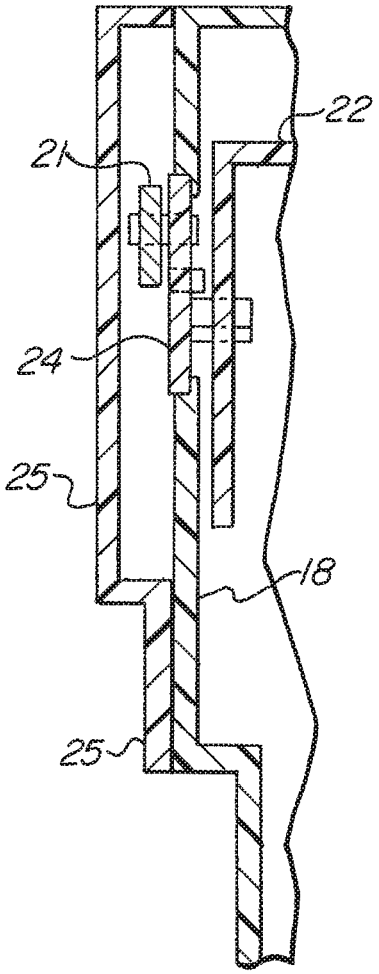
FIG. 7 is an illustration of a cross-section of the circuit breakers according to FIG. 5 showing the trip member connection.

As further shown in FIGS. 5-6, a gap is provided between the coupler disc 24 and the circular opening 32 on the inside case 18. The width of the gap provided will vary by application. For instance, in heavy duty applications the force exerted on the trip member 21 by the coupler disc 24 can be rapid and have a high magnitude, which when transmitted through the elongated trip member 21 can cause the coupler discs 24 to shift and exert a large amount of force on the tripping mechanism through the actuator 22. Such a force can cause malfunctions and premature wear to the components of the circuit breaker. Thus, in order to limit this force, the gap provided between the coupler disc 24 and the circular opening 32 on the inside case 18 is narrowed such that during actuation the outer edge 40 of the coupler disc 24 interacts with the inner edge 42 of the circular opening 32 in the inside case 18. This interaction acts as a bearing surface and helps to restrict the motion in the system to the desired rotational motion on the actuator 22. The coupler disc 24 inserted within the circular opening 32 on the inside case 18 is shown in FIG. 7, which is a cross-sectional view of the breaker of FIG. 5.

Figure 8:
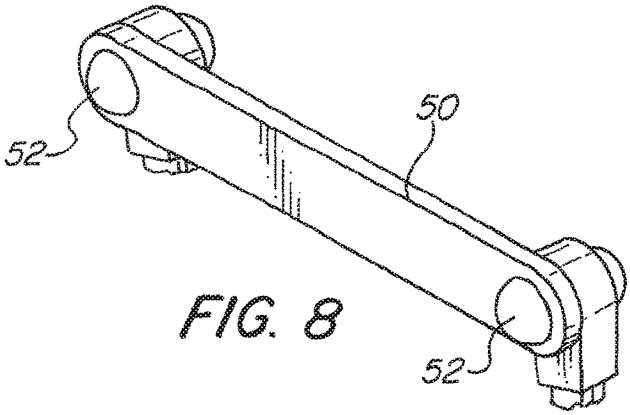
FIG. 8 is an illustration of a handle connection member.
Figure 9:
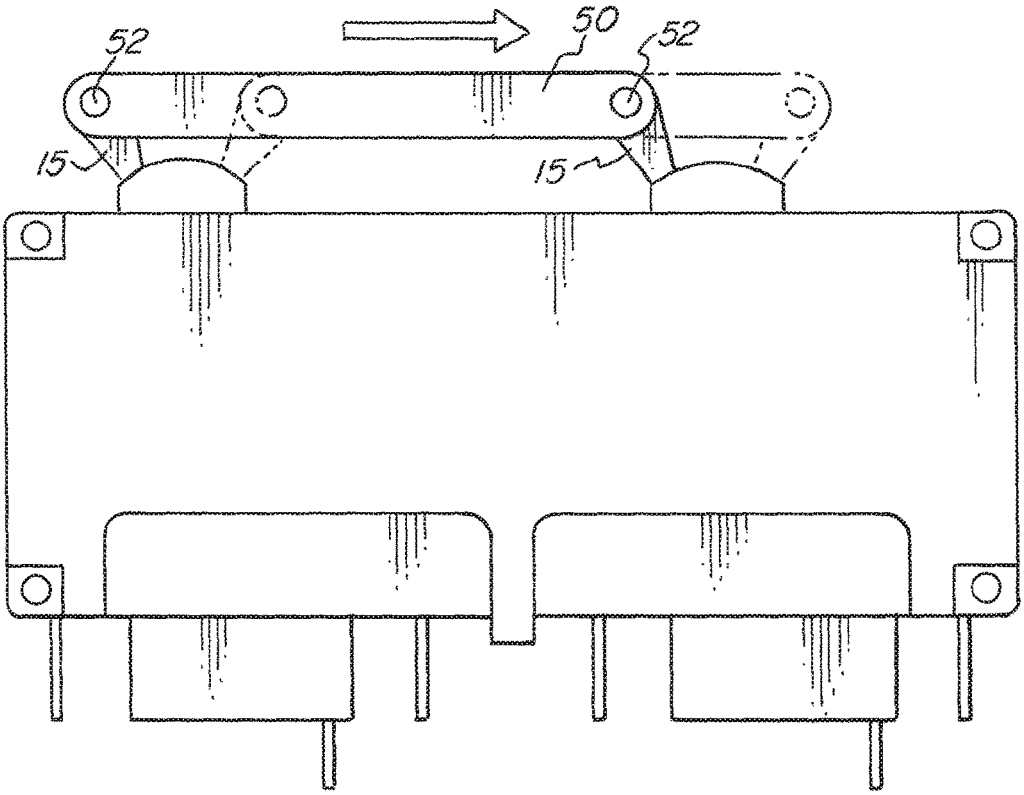
FIG. 9 is an illustration of circuit breakers incorporating the handle connection member of FIG. 8.
Figure 10:
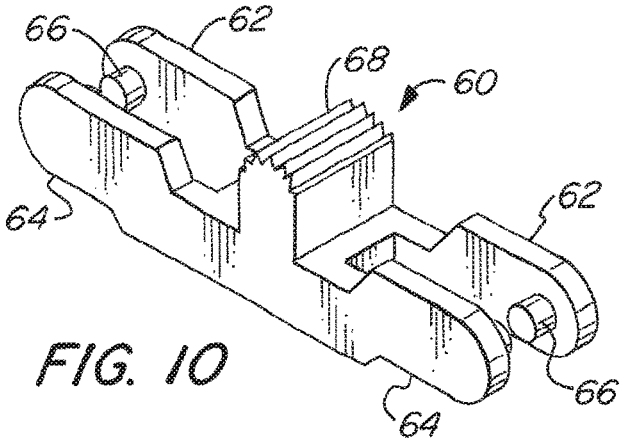
FIG. 10 is an illustration of another example of the handle connection member.
Figure 11:
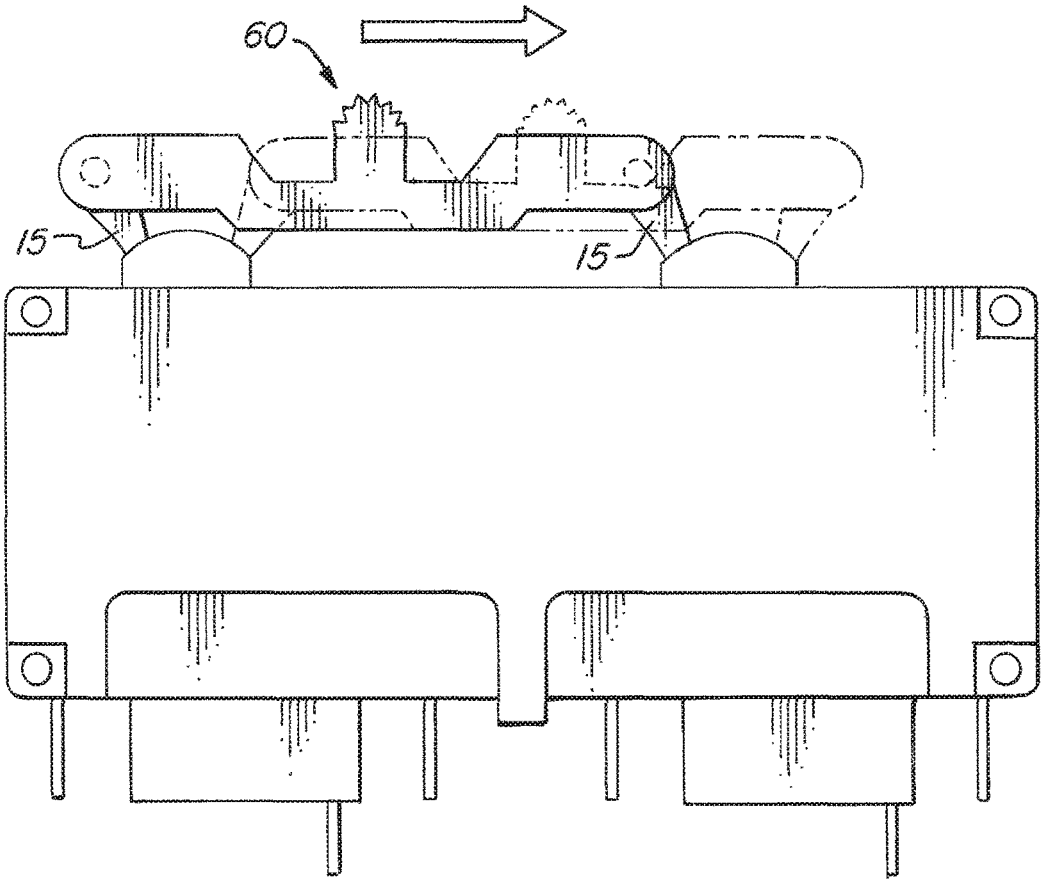
FIG. 11 is an illustration of circuit breakers incorporating the handle connection member of FIG. 10.

If certain types of circuit breakers are used in the present invention, it is not possible to simultaneously reset the tripping mechanisms of the circuit breakers through the common trip assembly 20. Therefore, it may be necessary to connect the handles 15 of the circuit breakers in order to reset the circuit breaker assembly 10 after either a fault or if the breakers have been manually tripped. FIGS. 8-13 show three different embodiments of connectors for the handles 15 of the circuit breakers 12, 14. The embodiment of FIGS. 8-9 shows a connecting bar 50, which connects the holes 17 in the handles 15 via a fastener 52. The embodiment of FIGS. 10-11 shows a single piece connector 60. The single piece connector 60 has middle handle portion 68 from which two legs 62, 64 extend from either side. All four of the legs 62, 64 have a projection 66 extending inward. The four projections 66 connect with the holes 17 in the handles 15.

Figure 12:
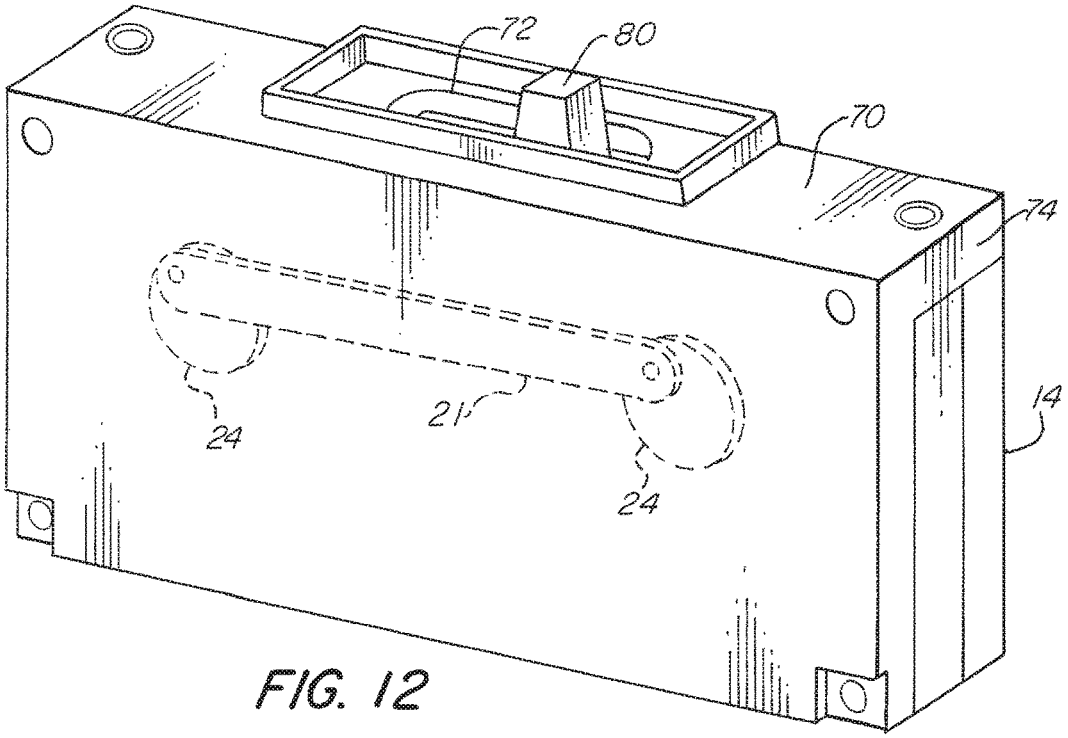
FIG. 12 is an illustration of another example incorporating a handle connection member.
Figure 13:
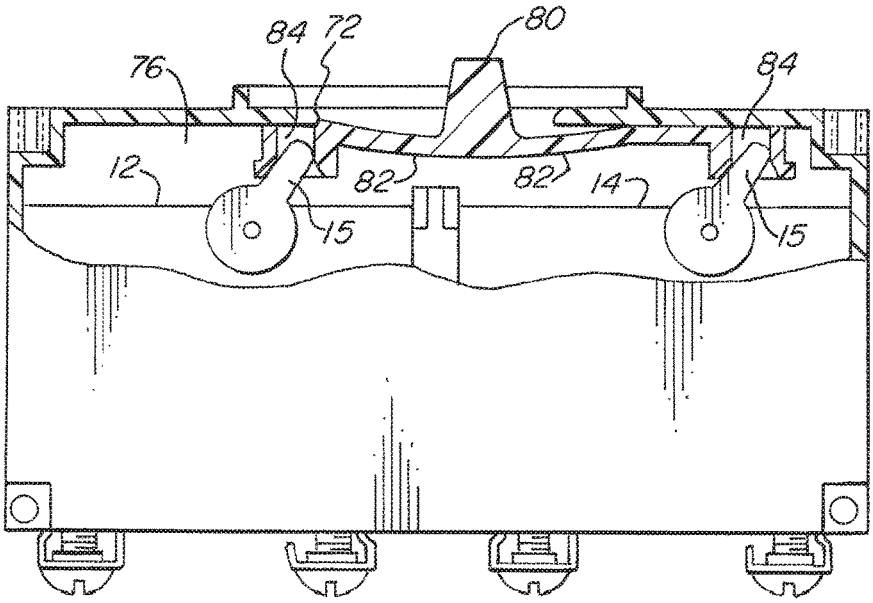
FIG. 13 is an illustration of the circuit breaker arraignment according to FIG. 12.

FIGS. 12-13 show a third embodiment of a handle connector 80, wherein the cover 70 is formed in a L-shape such that it conceals both the common trip assembly 20 and the handles 15 for the circuit breaker 12, 14. The cover 70 has an open space 76 in which the handles 15 for the circuit breaker 12, 14 are contained and a top opening 72 to access the handle connector 80. The open space 76 houses the handle connector 80 and provides a track for the handle connector 80 to slide back and forth. The handle connector 80 has two extension pieces 82 with a cavity 84 at their distal end. The handle 15 for each breaker 12, 14 fits into the cavity 84 at the end of the extension piece 82. When manually tripping or resetting the circuit breakers 12, 14 a user simply moves the handle connector 80 to the desired position and the handles 15 of the breakers are actuated by the cavity 84 at the end of each extension piece 82. The advantages of the embodiment shown in FIGS. 12-13 are that the L-shaped case provides more rigidity to the assembly and also prevents dust and other debris from entering the inside of the breakers 12, 14 through the area of the where the handles 15 extend.

Although the invention has been described with reference to a particular arrangement of parts, features and the like, these are not intended to exhaust all possible arrangements or features, and indeed many modifications and variations will be ascertainable to those of skill in the art.

What is claimed is:

1. A circuit breaker assembly comprising:

a first circuit breaker having a first housing containing a first trip mechanism with a first axis, the first housing having a circular opening;

a second circuit breaker having a second housing containing a second trip mechanism with a second axis, the second housing having a circular opening;

a first coupler disc positioned in the circular opening of the first housing and connected to the first trip mechanism;

a second coupler disc positioned in the circular opening of the second housing and connected to the second trip mechanism;

said first circuit breaker and said second circuit breaker aligned such that the first axis and the second axis are parallel and separated by a distance;

an elongated trip member having a first end with a first pivot connection and a second end with a second pivot connection;

the first pivot connection connected to the first coupler disc and the second pivot connection connected to the second coupler disc such that when the first trip mechanism actuates from an untripped state to a tripped state, said elongated trip member actuates the second trip mechanism from an untripped state to a tripped state; and a cover positioned over the elongated trip member, said cover fastened to said first circuit breaker and said second circuit breaker.

2. The circuit breaker assembly of claim 1, wherein said first circuit breaker further includes a first handle for actuating the first trip mechanism between the untripped state and the tripped state; and said second circuit breaker further includes a second handle for actuating the second trip mechanism between the untripped state and the tripped state;

wherein said first handle and said second handle are coupled to each other via a connector.

3. The circuit breaker assembly of claim 1, wherein a first gap between the opening in the first housing and the first coupler disc and a second gap between the opening in the second housing and the second coupler disc are provided such that an inner edge of the opening in the first housing acts as a bearing surface for an outside edge of the first coupler, and an inner edge of the opening in the second housing acts as a bearing surface for an outside edge of the second coupler.

4. The circuit breaker assembly of claim 2, wherein the connector comprises a bar that is coupled to the first handle by a first fastener and is coupled to the second handle by a second fastener.

5. The circuit breaker assembly of claim 2, wherein the connector is a one piece assembly having a center section from which a first and second set of legs protrude from opposite sides respectively, the first set of legs having a set of first projections protruding inward and the second set of legs having a set of second projections protruding inward, wherein the first set of projections are functionally connected with the first handle and the second set of projections are functionally connected with the second handle.

6. The circuit breaker assembly of claim 2, wherein the connecter includes a first end with a first cavity and a second end with a second cavity, wherein the first handle fits into the first cavity and the second handle fits into the second cavity.

7. A circuit breaker assembly comprising:

a first circuit breaker having a first housing containing a first trip mechanism with a first axis, the first housing having a first side and two ends perpendicular to the first side, the two ends being parallel to one another;

a second circuit breaker having a second housing containing a second trip mechanism with a second axis, the second housing having a second side and two ends perpendicular to the second side, the two ends being parallel to one another;

said first circuit breaker and said second circuit breaker aligned such that the first axis and the second axis are parallel and separated by a distance; and an elongated trip member that runs along the first side and the second side, said elongated trip member connected to the first trip mechanism through a first opening in the first side and the second trip mechanism through a second opening in the second side such that when the first trip mechanism actuates from an untripped state to a tripped state, said elongated trip member actuates the second trip mechanism from an untripped state to a tripped state.

8. The circuit breaker assembly of claim 7, wherein said first circuit breaker includes a first handle for actuating the first trip mechanism between the untripped state and the tripped state;

said second circuit breaker includes a second handle for actuating the second trip mechanism between the untripped state and the tripped state; and wherein said first handle and said second handle are coupled to each other via a connector.

9. The circuit breaker assembly of claim 8, wherein the connector comprises a bar that is coupled to the first handle by a first fastener and the second handle by a second fastener.

10. The circuit breaker assembly of claim 8, wherein the connector is a one piece assembly having a center section from which a first and second set of legs protrude from opposing sides, the first set of legs having a set of first projections protruding inward and the second set of legs having a set of second projections protruding inward, wherein the first set of projections are functionally connected to the first handle and the second set of projections are functionally connected to the second handle.

11. The circuit breaker assembly of claim 8, wherein the connector includes a first end with a first cavity and a second end with a second cavity, wherein the first handle fits into the first cavity and the second handle fits into the second cavity.

12. The circuit breaker assembly of claim 7, wherein the circuit breaker assembly further includes a first and a second coupler, wherein said first coupler fits into the opening in the first housing and is connected to the first trip mechanism and the second coupler fits into the opening in the second housing and is connected to the second trip mechanism, and wherein the elongated trip member is connected to the first and second coupler.

13. The circuit breaker assembly of claim 12, wherein said first circuit breaker includes a first handle for actuating the first trip mechanism between the untripped state and the tripped state; and said second circuit breaker includes a second handle for actuating the second trip mechanism between the untripped state and the tripped state;

wherein said first handle and said second handle are coupled to each other via a connector.

14. The circuit breaker assembly of claim 12, wherein the openings in the first and second housings are circular, and wherein the first and second couplers are formed as discs.

15. The circuit breaker assembly of claim 14, wherein a first gap between the first opening and the first coupler disc and a second gap between the second opening and the second coupler disc are provided such that an inner edge of the opening in the first housing acts as a bearing surface for an outside edge of the first coupler, and an inner edge of the opening in the second housing acts as a bearing surface for an outside edge of the second coupler.

16. The circuit breaker assembly of claim 14, wherein the connector comprises a bar that is coupled to the first handle by a first fastener and to the second handle by a second fastener.

17. The circuit breaker assembly of claim 14, wherein the connector is a one piece assembly having a center section from which a first and second set of legs protrude from opposite sides, the first set of legs having a set of first projections protruding inward and the second set of legs having a set of second projections protruding inward, wherein the first set of projections functionally connect with the first handle and the second set of projections functionally connect with the second handle.

18. The circuit breaker assembly of claim 14, wherein the connector includes a first end with a first cavity and a second end with a second cavity, wherein the first handle fits into the first cavity and the second handle fits into the second cavity.

19. A circuit breaker assembly comprising:

a plurality of circuit breakers, each circuit breaker comprising:

a housing having a first side and two ends perpendicular to the first side, the two first ends being parallel to one another;

a handle movable between an on position and an off position;

a circuit breaker linkage mechanism having a tripped state and an untripped state, said circuit breaker linkage mechanism disposed to change the position of at least one contact when the circuit breaker linkage mechanism changes state, said circuit breaker linkage mechanism being operably connected between the handle and the at least one contact, such that manual manipulation of the handle causes movement of the circuit breaker linkage mechanism, thereby causing movement of the at least one contact;

an opening on the first side of said breaker;

a coupler positioned in the opening of the first side and connected to the circuit breaker linkage;

said plurality of breakers aligned in an end-to-end fashion such that said first sides are oriented in the same direction and are aligned along a plane;

an elongated trip member extending along the first sides of said plurality of circuit breakers, said elongated trip member having a first end with a first pivot connection and a second end with a second pivot connection, the first pivot connection connected to a first coupler and the second pivot connection connected to a second coupler such that when one of said circuit breaker linkages actuates from the untripped state to the tripped state, the remaining said circuit breaker linkages of said plurality of circuit breakers are also actuated from the untripped state to the tripped state; and a handle coupler connecting each handle of said plurality of breakers.

20. The circuit breaker assembly of claim 19, wherein the opening is circular and a gap is formed between the coupler and the opening such that an inner edge of the opening acts as a bearing surface for an outside edge of the coupler.

* * * * *